US005543277A

United States Patent [19]

Singer et al.

[11] Patent Number: 5,543,277

[45] Date of Patent: Aug. 6, 1996

[54] PHOTOGRAPHIC ELEMENTS CONTAINING SCAVENGERS FOR OXIDIZED DEVELOPING AGENT

[75] Inventors: Stephen P. Singer, Spencerport; John W. Harder, Rochester, both of N.Y.

[73] Assignee: Eastman Kodak Company, Rochester, N.Y.

[21] Appl. No.: 397,029

[22] Filed: Mar. 1, 1995

Related U.S. Application Data

[63] Continuation of Ser. No. 233,196, Apr. 26, 1994, abandoned.

[51] Int. Cl.[6] ..... G03C 1/46

[52] U.S. Cl. ..... 430/505; 430/264; 430/598; 430/551; 430/486; 430/490

[58] Field of Search ..... 430/505, 264, 430/598, 551, 486, 490

[56] References Cited

U.S. PATENT DOCUMENTS 4,923,787 5/1990 Harder ..... 430/489
5,230,992 7/1993 Miyahashi et al. ..... 430/505
5,262,274 11/1993 Katoh ..... 430/598

FOREIGN PATENT DOCUMENTS 4-238347 8/1992 Japan .

*Primary Examiner*—Geraldine Letscher
*Attorney, Agent, or Firm*—Alfred P. Lorenzo

[57] ABSTRACT

An improved photographic element comprises a support bearing at least-one silver halide emulsion layer having associated therewith a hydrazide compound that functions as a scavenger for oxidized developing agent. The hydrazide compound comprises at least one polyhydroxy aromatic nucleus or a precursor thereof and at least one moiety containing an $$-\overset{|}{N}-\overset{|}{N}-$$

group which is bonded to a ring carbon atom of the polyhydroxy aromatic nucleus or precursor thereof through a linking group. The linking group can be an oxy, thio, sulfinyl, sulfonyl or alkylene group or it can be a carbonyl group when the polyhydroxy aromatic nucleus comprises at least three hydroxyl groups.

22 Claims, No Drawings

PHOTOGRAPHIC ELEMENTS CONTAINING SCAVENGERS FOR OXIDIZED DEVELOPING AGENT

This is a continuation of U.S. application Ser. No. 233,196, filed 26 Apr. 1994, now abandoned.

FIELD OF THE INVENTION

This invention relates in general to photography and in particular to photographic elements comprising at least one radiation-sensitive silver halide emulsion layer. More specifically, this invention relates to improved photographic elements containing compounds which act as scavengers for oxidized developing agent.

BACKGROUND OF THE INVENTION

It is known in the art to add a scavenger to a photographic element in order for the scavenger to prevent oxidized developing agent from reacting within the element at an undesired location or at an undesired point in time. In particular, it is undesirable for oxidized developer to diffuse away from the imaging layer in which it formed and into other color records where it can form dye in the wrong layer. In some formats, it can also be undesirable for toe scale and fog considerations to have oxidized developer form dye at early stages of development. Typically, scavengers reduce or eliminate oxidized developers without forming any permanent dyes and do not cause stains nor release fragments that have photographic activity. They are also typically rendered substantially immobile in the element by incorporation of an anti-diffusion group (a ballast) or by attachment to a polymer backbone.

Known scavengers for oxidized developers include ballasted hydroquinone (1,4-dihydroxybenzene) compounds as described in U.S. Pat. Nos. 3,700,453 and 4,732,845; ballasted gallic acid (1,2,3-trihydroxybenzene) compounds as described in U.S. Pat. No. 4,474,874; ballasted sulfonamidophenols as described in U.S. Pat. Nos. 4,205,987 and 4,447,523; and ballasted resorcinol (1,3-dihydroxybenzene) compounds as described in U.S. Pat. Nos. 3,770,431. Such known materials are insufficient in their activity, requiring high material usage, thus increasing cost, storage and handling concerns as well as requiring thicker layers, thus degrading sharpness through increased scatter path length. In addition, because these known materials are sensitive to oxidative conditions, they are often insufficiently stable upon long term storage. Finally, many of these materials form stains or colored residues during processing.

It is also known to use certain hydrazide compounds in color photographic elements as scavengers for oxidized developing agent. Thus, for example, U.S. Pat. No. 4,923,787 discloses the use of hydrazides of the formula

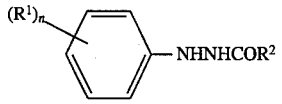

wherein $R^1$ is an electron-donating group, $R^2$ is hydrogen, alkyl, alkoxy, aryl, aryloxy, aralkyl or amino and n is 1 or 2; and Japanese Patent Publication No. 4,238,347, published Aug. 26, 1992, discloses the use of hydrazides of the formula

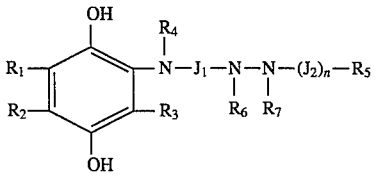

wherein $R_1$, $R_2$ and $R_3$ are hydrogen, halogen, alkyl, alkenyl, alkoxy, aryloxy, alkylthio, arylthio, acylamino, sulfonyl, carbamoyl, sulfamoyl or sulfo, $R_1$ and $R_2$ can connect to form a ring structure;

$R_4$, $R_6$ and $R_7$ are hydrogen or alkyl;

$R_5$ is alkyl, cycloalkyl, aralkyl, alkenyl, aryl or a hetero ring;

$J_1$ is —CO—, —SO— or —$SO_2$—;

$J_2$ is —CO—, —SO—, —$SO_2$— or —COCO—; and n is zero or one.

U.S. Pat. No. 5,230,992, issued Jul. 27, 1993, also discloses color photographic elements containing a hydrazide compound to reduce color staining and color fog. The compounds disclosed have the formula

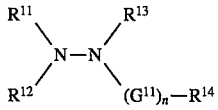

wherein $R^{11}$, $R^{12}$ and $R^{13}$ represent hydrogen, an aliphatic group or an aromatic group, $R^{14}$ represents hydrogen, an alkyl group, an aralkyl group, an aryl group, a heterocyclic group, an alkoxy group, an aryloxy group, an amino group, .an alkoxycarbonyl group, an aryloxycarbonyl group or a carbamoyl group, $G^{11}$ represents a carbonyl group, a sulfonyl group, a sulfinyl group, a

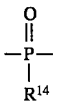

group, or an iminomethylene group, and n is 0 or 1.

The hydrazide compounds described above suffer from many of the same disadvantages and deficiencies as the hydroquinone, gallic acid, sulfonamidophenol and resorcinol compounds. In particular, these hydrazide compounds are especially deficient in regard to activity and long-term storage stability.

It is an objective of this invention to provide a new class of reactive scavengers for oxidized developer which can be incorporated in a wide range of photographic elements, and especially in color elements to prevent color contamination between layers, to prevent stain and to reduce fog. It is a particular objective of this invention to provide a new class of reactive scavengers that have high activity, that have excellent stability upon long-term storage and that do not leave colored residues after processing.

SUMMARY OF THE INVENTION

In accordance with this invention, a photographic element comprises a support bearing at least one silver halide emulsion layer having associated therewith a hydrazide compound that functions as a scavenger for oxidized developing agent; wherein the hydrazide compound:

(a) comprises at least one polyhydroxy aromatic nucleus or a precursor thereof;

(b) comprises at least one moiety containing an

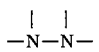

group wherein such moiety is bonded directly to a ring carbon atom of the polyhydroxy aromatic nucleus or precursor thereof through an oxy, thio, sulfinyl, sulfonyl, carbonyl or alkylene group, with the proviso that when such moiety is bonded to the ring carbon atom through a carbonyl group then the polyhydroxy aromatic nucleus comprises at least three hydroxyl groups; and (c) has sufficient bulk that it is substantially non-diffusible in the photographic element.

The hydrazide compounds utilized as scavengers in this invention differ from hydrazide compounds utilized as scavengers in the prior art in that the moiety containing the

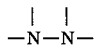

group is bonded to a ring carbon atom of a polyhydroxy aromatic nucleus through one of the linking groups specified herein. When the linking group is an oxy, thio, sulfinyl, sulfonyl or alkylene group, then the polyhydroxy aromatic nucleus can contain two or more hydroxyl groups. When the linking group is a carbonyl group, then the polyhydroxy aromatic nucleus contains at least three hydroxyl groups. Hydrazide compounds having this particular structure have been unexpectedly found to provide greatly enhanced long-term storage stability along with very high activity and to effectively overcome the problem of colored residue formation which has hindered prior efforts to utilize scavengers on a commercial basis.

As explained above, the linking group can be an oxy group (—O—), a thio group (—S—), a sulfinyl group (—SO—), a sulfonyl group (—$SO_2$—), a carbonyl group

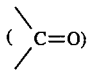

or an alkylene group. The alkylene group preferably contains 1 to 30 carbon atoms, more preferably 1 to 8 carbon atoms, and most preferably 1 to 4 carbon atoms.

DETAILED DESCRIPTION OF THE INVENTION

As hereinabove described, the present invention pertains to the use in silver halide photographic elements of certain hydrazide compounds which function as scavengers for oxidized developing agent. By the term "hydrazide compound", as used herein, is meant any compound comprising a moiety that contains an

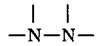

group.

Scavengers are compounds which react with oxidized developing agents by mechanisms such as cross-oxidation or coupling and deactivate the oxidized developing agent without forming permanent image. They can be incorporated within a silver halide emulsion layer to control curve shape. They can be incorporated within an interlayer to provide improved color reproduction.

The hydrazide compounds of this invention are highly effective scavengers which are utilized in association with a silver halide emulsion layer by which is meant that they can be incorporated in a silver halide emulsion layer or in any other layer of a photographic element from which they can modify the characteristics of a silver halide emulsion layer.

The hydrazide compounds utilized in this invention comprise at least one polyhydroxy aromatic nucleus or a precursor thereof. By a "precursor" is meant an aromatic nucleus substituted with labile groups which form hydroxyl groups upon processing of the photographic element. Examples of such labile groups include alkyl esters, sulfonyl esters, carbamates, phosphates and carbonates. The labile groups are alkali-decomposable groups in which the hydrogen atom of an hydroxyl group has been substituted with a blocking group that is eliminated upon contact with an alkali. A typical blocking group is one that can be eliminated by hydrolysis or intermolecular nucleophilic substitution. Typical examples of the blocking group that can be eliminated by hydrolysis include acyl groups such as aliphatic and aromatic carbonyl groups, and a sulfonyl group. Exemplary blocking groups are described in U.S. Pat. Nos. 4,310,612, 4,358,525, 4,554,243 and 4,690,885. Also useful are coupler moieties that release the scavenger upon reaction with oxidized developing agent as described in U.S. Pat. No. 4,741,994 and European Patent 0 383 637. Particularly preferred blocking groups for the purpose of this invention are those described in U.S. Pat. No. 5,019,492.

Hydrazide compounds which are preferred for the purpose of this invention are those in which the polyhydroxy aromatic nucleus is a polyhydroxybenzene nucleus and hydrazide compounds which are particularly preferred are those in which the polyhydroxy aromatic nucleus is a dihydroxybenzene nucleus. Typical examples of a polyhydroxy aromatic nucleus include 1,2-dihydroxybenzene; 1,4-dihydroxybenzene; 1,2,3trihydroxybenzene; 1,4-dihydroxynaphthalene; and 2,6-dihydroxypyridine.

As hereinabove described, the hydrazide compounds utilized in this invention comprise at least one moiety containing an

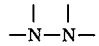

group and such moiety is bonded to a ring carbon atom of the polyhydroxy aromatic nucleus or precursor thereof through a linking group. The linking group is an oxy, thio, sulfinyl, sulfonyl, carbonyl or alkylene group with the proviso that when the linking group is carbonyl then the polyhydroxy aromatic nucleus comprises at least three hydroxyl groups. The reason for such proviso is that a carbonyl group is a strongly electron-withdrawing substituent and when it is attached to a ring carbon atom of the polyhydroxy aromatic nucleus it raises the oxidation potential of the nucleus and makes external redox reactions with oxidized developing agent or internal redox reactions with the hydrazide moiety less favorable. Thus, when a carbonyl group is employed as the linking group the extra electron donation of a third hydroxyl group balances out the increased electron withdrawal of the carbonyl group and excellent activity is maintained.

The linking group is a critical feature of the present invention. Since it bonds directly to a ring carbon atom of the polyhydroxyaromatic nucleus it affects the types of reactions in which such nucleus can take place. In the prior art, there is no recognition of the critical importance of this linking group.

Preferred hydrazide compounds for use in this invention are compounds of the formula:

A—B—(L)—C wherein A represents an aromatic nucleus that contains two hydroxyl groups that are conjugated to each other, for example in a 1,2 or 1,4 relationship, so that the nucleus can be readily oxidized to the corresponding quinoid form;

B represents an oxygen atom or a substituted carbon atom attached directly to a ring carbon atom of the aromatic nucleus A;

C represents an organic radical that contains an —NH—NH— group; and

L represents an optional organic radical that chemically connects B and C.

Particularly preferred hydrazide compounds for use in this invention are compounds of the formula:

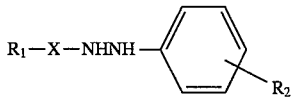

wherein

X represents —C— or —$SO_2$—, $R_1$ represents an alkyl, alkyloxy, aryl, aryloxy, aralkyl or amino group;

$R_2$ represents hydrogen or an alkyl, alkyloxy, aryl, aryloxy, aralkyl, amino, acylamido, sulfonamido or ureido group;

at least one of $R_1$ and $R_2$ contains a polyhydroxybenzene group of the formula:

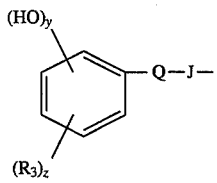

wherein:

y=2 and the OH groups are in a 1,2 or 1,4 relationship to each other;

Q=oxygen, sulfur or a

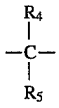

group;

$R_3$=hydrogen, aryl, sulfonamido, carbonamido, sulfonic acid or a salt thereof, halogen, alkyl or alkyloxy;

$R_4$ and $R_5$ are individually hydrogen, alkyl, aryl, thiol, amino, aryloxy or alkyloxy and $R_4$ and $R_5$ can form a ring system when taken together or when taken in combination with $R_3$;

z=0–3;

J is an optional linking group that chemically connects Q to $R_1$ or $R_2$.

Examples of suitable groups represented by J include —Z—, —$(CR_4R_5)_x$—, —$(CR_4R_5)_x$—Z—, —Z—$(CR_4R_5)_x$—Z—, and —$(CR_4R_5)_x$—Z—$(CR_4R_5)_w$ wherein Z=oxygen or mono-substituted nitrogen, x=1 to 30 w=1 to 30.

The most preferred hydrazide compounds for use in this invention are compounds of the formula:

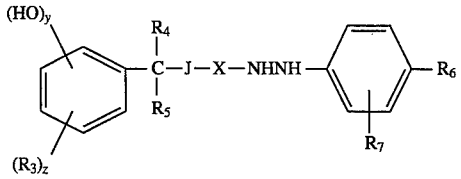

wherein X, J, $R_3$, z, y, $R_4$ and $R_5$ are as defined above;

$R_6$ and $R_7$ individually represent a group that has a para Hammett Substituent Constant less than 0.10 such as hydrogen; alkyl which can be substituted or unsubstituted and straight or branched chain having 1 to about 30 carbon atoms, preferably 1 to 16 carbon atoms; alkoxy which can be substituted or unsubstituted and straight or branched chain having,1 to about 30 carbon atoms, preferably 1 to 16 carbon atoms; carboxy, carbonamido (preferably of the formula —$NR_3COR_4$); sulfonamido (preferably of the formula —$NR_3SO_2R_4$) or amino which preferably has the formula —$NR_3R_4$ and is located para to the nitrogen of the hydrazide group; and $R_6$ and $R_7$ taken together with the atoms to which they are attached can form a ring system.

Examples of hydrazide compounds that are usefully employed as scavengers in the photographic elements of this invention include the following:

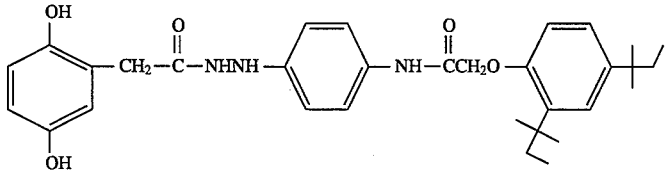

S-1

-continued
S-2
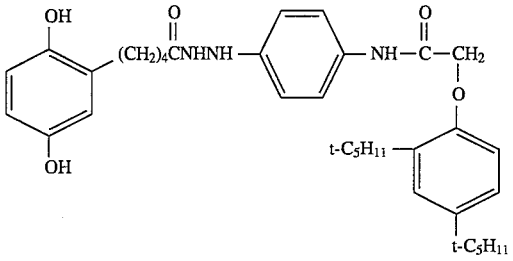
S-3
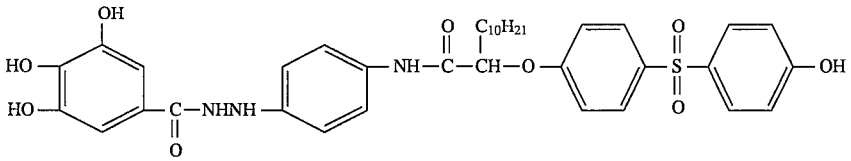
S-4
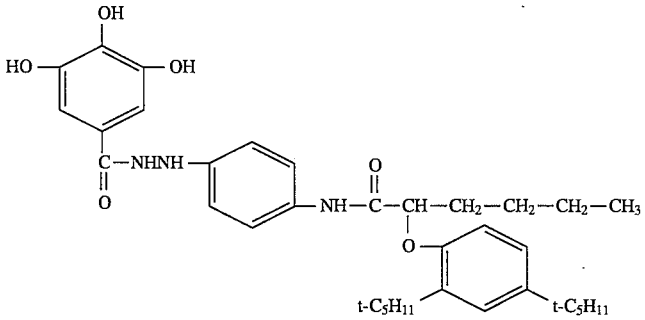
S-5
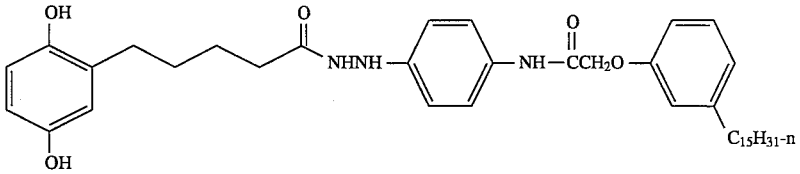
S-6
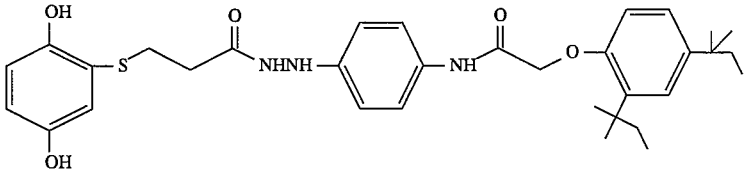
S-7
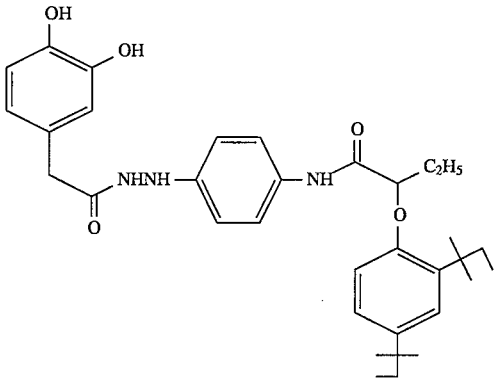

-continued
S-8
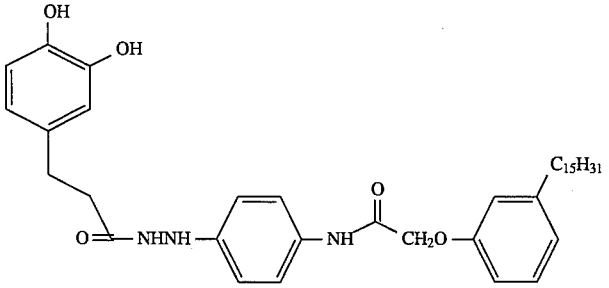
S-9
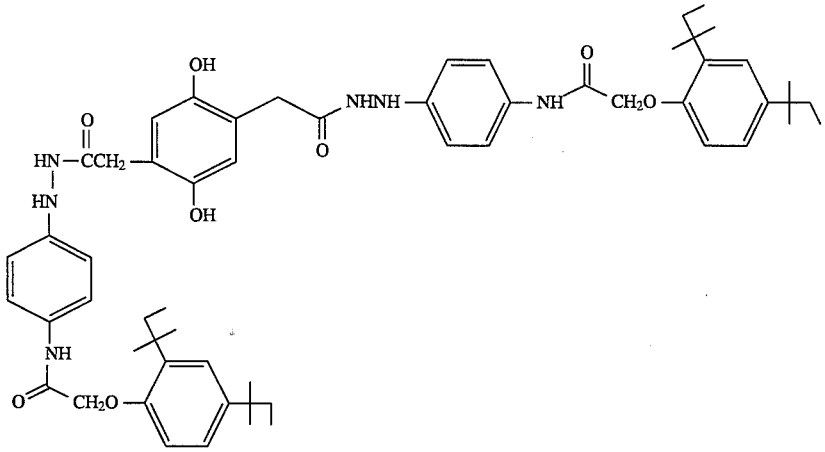
S-10
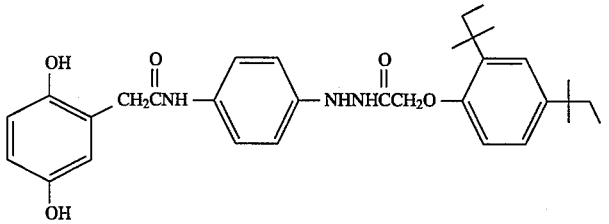
S-11
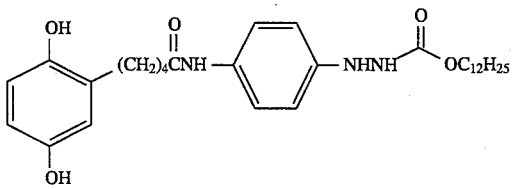
S-12
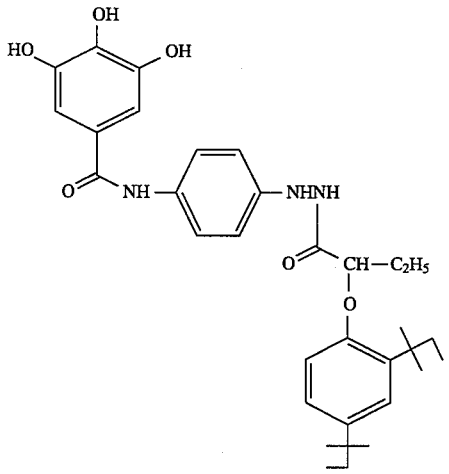

Scavengers outside of the scope of the present invention which have been evaluated herein for purposes of comparison include the following:

SC-1

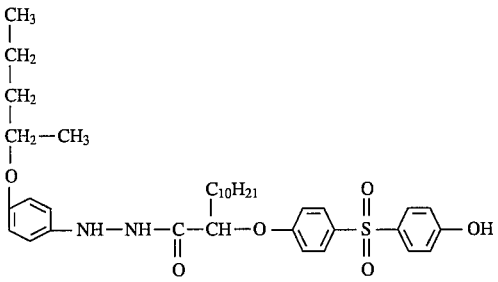

SC-2

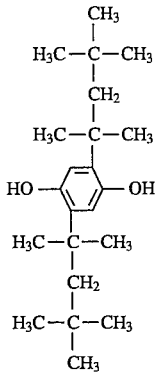

SC-3

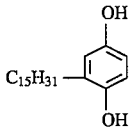

SC-4

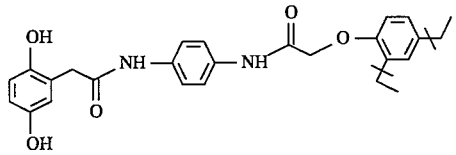

SC-5

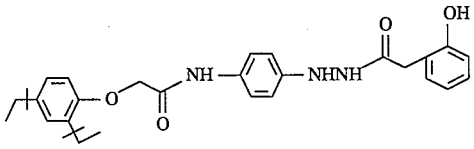

SC-6

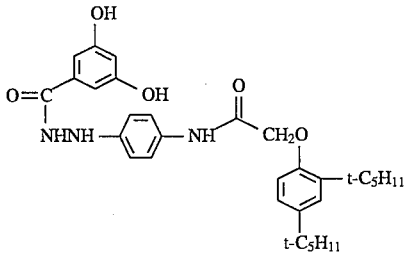

SC-7

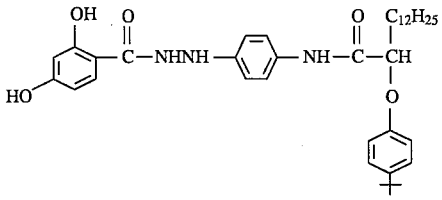

-continued

SC-8

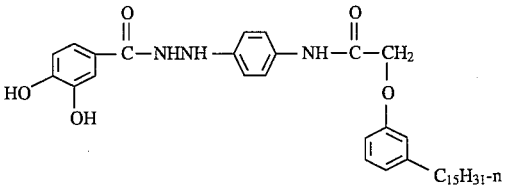

SC-9

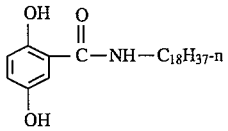

SC-10

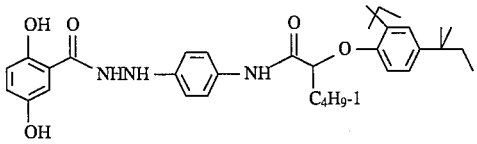

The photographic elements of the present invention can be simple black-and-white or monochrome elements comprising a support bearing a layer of silver halide emulsion or they can be multilayer and/or multicolor elements.

Color photographic elements of this invention typically contain dye image-forming units sensitive to each of the three primary regions of the spectrum. Each unit can be comprised of a single silver halide emulsion layer or of multiple emulsion layers sensitive to a given region of the spectrum. The layers of the element, including the layers of the image-forming units, can be arranged in various orders as is well known in the art.

A preferred photographic element according to this invention comprises a support bearing at least one blue-sensitive silver halide emulsion layer having associated therewith a yellow image dye-providing material, at least one green-sensitive silver halide emulsion layer having associated therewith a magenta image dye-providing material and at least one red-sensitive silver halide emulsion layer having associated therewith a cyan image dye-providing material, the element containing a hydrazide compound that functions as a scavenger in accordance with this invention. Preferably the scavenger is incorporated in an interlayer between silver halide emulsion layers sensitive to different regions of the visible spectrum, although it can be incorporated in an interlayer between silver halide emulsion layers sensitive to the same region of the visible spectrum. The scavenger can be incorporated in layers which also have other functions, such as, for example, antihalation layers or filter layers.

In addition to emulsion layers and interlayers, the elements of the present invention can contain auxiliary layers conventional in photographic elements, such as overcoat layers, spacer layers, filter layers, antihalation layers, pH lowering layers (sometimes referred to as acid layers and neutralizing layers), timing layers, opaque reflecting layers, opaque light-absorbing layers and the like. The support can be any suitable support used with photographic elements. Typical supports include polymeric films, paper (including polymer-coated paper), glass and the like. Details regarding supports and other layers of the photographic elements of this invention are contained in *Research Disclosure,* Item 308119, December, 1989.

The light-sensitive silver halide emulsions employed in the photographic elements of this invention can include coarse, regular or fine grain silver halide crystals or mixtures thereof and can be comprised of such silver halides as silver chloride, silver bromide, silver bromoiodide, silver chlorobromide, silver chloroiodide, silver chorobromoiodide, and mixtures thereof. The emulsions can be, for example, tabular grain light-sensitive silver halide emulsions. The emulsions can be negative-working or direct positive emulsions. They can form latent images predominantly on the surface of the silver halide grains or in the interior of the silver halide grains. They can be chemically and spectrally sensitized in accordance with usual practices. The emulsions typically will be gelatin emulsions although other hydrophilic colloids can be used in accordance with usual practice. Details regarding the silver halide emulsions are contained in *Research Disclosure,* Item 308119, December, 1989, and the references listed therein.

The photographic silver halide emulsions utilized in this invention can contain other addenda conventional in the photographic art. Useful addenda are described, for example, in *Research Disclosure,* Item 308119, December, 1989. Useful addenda include spectral sensitizing dyes, desensitizers, antifoggants, masking couplers, DIR couplers, DIR compounds, antistain agents, image dye stabilizers, absorbing materials such as filter dyes and UV absorbers, light-scattering materials, coating aids, plasticizers and lubricants, and the like.

Depending upon the dye-image-providing material employed in the photographic element, it can be incorporated in the silver halide emulsion layer or in a separate layer associated with the emulsion layer. The dye-image-providing material can be any of a number known in the art, such as dye-forming couplers, bleachable dyes, dye developers and redox dye-releasers, and the particular one employed will depend on the nature of the element, and the type of image desired.

Dye-image-providing materials employed with conventional color materials designed for processing with separate solutions are preferably dye-forming couplers; i.e., compounds which couple with oxidized developing agent to form a dye. Preferred couplers which form cyan dye images are phenols and naphthols. Preferred couplers which form magenta dye images are pyrazolones and pyrazolotriazoles. Preferred couplers which form yellow dye images are benzoylacetanilides and pivalylacetanilides.

The amount of scavenger compound employed will depend upon the particular purpose for which the scavenger is to be used and the degree of scavenging desired. Typically useful results are obtained when the scavenger is employed in an amount of between about 5 and 2000 mg/square meter.

The hydrazide compound is typically incorporated in the photographic element with the aid of a suitable solvent such as a coupler solvent. Examples of preferred coupler solvents that can be utilized for this purpose in this invention include:

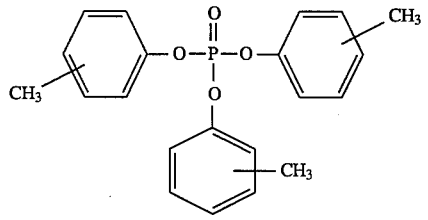

CS-1

(mixture of ortho, meta and para isomers)

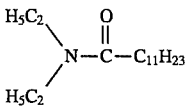

CS-2

-continued

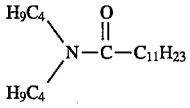

CS-3

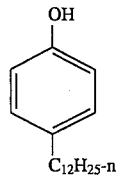

CS-4

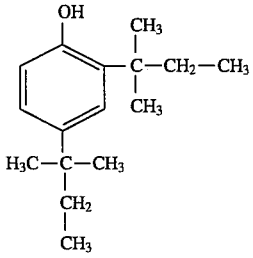

CS-5

$O{=}P(OC_6H_{13}\text{-}n)_3$

CS-6

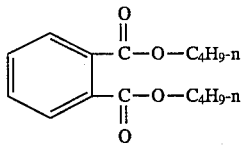

CS-7

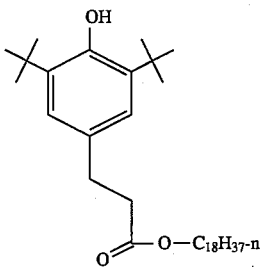

CS-8

In the practice of this invention, it is desirable to incorporate a surfactant in one or more layers of the photographic element. Examples of useful surfactants include nonionic surfactants such as SURFACTANT 10G from OLIN MATHIESON CORPORATION and anionic surfactants such as TRITON X-200E from ROHM AND HAAS CORPORATION or AEROSOL TO from AMERICAN CYANAMID COMPANY.

The problem of sensitizing dye stain, which is minimized or avoided by the use of a scavenger in accordance with this invention, is particularly severe with photographic elements utilizing tabular grain silver halide emulsions because such emulsions typically employ very high levels of sensitizing dye. However, because of their other advantageous characteristics use of tabular grain silver halide emulsions represents a particularly important embodiment of this invention.

Specifically contemplated tabular grain emulsions for use in this invention are those in which greater than 50 percent of the total projected area of the emulsion grains is accounted for by tabular grains having a thickness of less than 0.3 micron and an average tabularity (T) of greater than 25 (preferably greater than 100), where the term "tabularity" is employed in its art recognized usage as $$T=ECD/t^2$$

where

ECD is the average equivalent circular diameter of the tabular grains in microns and t is the average thickness in microns of the tabular grains.

The average useful ECD of photographic emulsions can range up to about 10 microns, although in practice emulsion ECD's seldom exceed about 4 microns. Since both photographic speed and granularity increase with increasing ECD's, it is generally preferred to employ the smallest tabular grain ECD's compatible with achieving aim speed requirements.

Emulsion tabularity increases markedly with reductions in tabular grain thickness. It is generally preferred that aim tabular grain projected areas be satisfied by thin (t<0.2 micron) tabular grains. To achieve the lowest levels of granularity it is preferred that aim tabular grain projected areas be satisfied with ultrathin (t<0.06 micron) tabular grains. Tabular grain thicknesses typically range down to about 0.02 micron. However, still lower tabular grain thicknesses are contemplated. For example, Daubendiek et al U.S. Pat. No. 4,672,027 reports a 3 mole percent iodide tabular grain silver bromoiodide emulsion having a grain thickness of 0.017 micron.

As noted above, tabular grains of less than the specified thickness account for at least 50 percent of the total grain projected area of the emulsion. To maximize the advantages of high tabularity it is generally preferred that tabular grains satisfying the stated thickness criterion account for the highest conveniently attainable percentage of the total grain projected area of the emulsion. For example, in preferred emulsions, tabular grains satisfying the stated thickness criteria above account for at least 70 percent of the total grain projected area. In the highest performance tabular grain emulsions, tabular grains satisfying the thickness criteria above account for at least 90 percent of total grain projected area.

In a particularly preferred embodiment, the present invention provides a multicolor photographic element capable of forming a dye image, which element comprises a support having thereon:

a blue-recording yellow-dye-image forming layer unit, a green-recording magenta-dye-image-forming layer unit, and a red-recording cyan-dye-image-forming layer unit, each of the dye-image-forming layer units comprising at least one silver halide emulsion layer containing at least one sensitizing dye; the element comprising at least one interlayer positioned between dye-image-forming layer units sensitive to different regions of the visible spectrum and the at least one interlayer containing a hydrazide compound as hereinabove described.

The photographic elements of this invention can be exposed to actinic radiation, typically in the visible region of the spectrum, to form a latent image and can then be processed to form a visible dye image. Processing to form a visible dye image includes the step of contacting the element with a color developing agent to reduce developable silver halide and oxidize the color developing agent. Oxidized color developing agent in turn reacts with the coupler to yield a dye.

Preferred color developing agents are p-phenylenediamines such as:

4-amino-N,N-diethylaniline hydrochloride, 4-amino-3-methyl-N,N-diethylaniline hydrochloride, 4-amino-3-methyl-N-ethyl-N-(b-(methanesulfonamido) ethyl)aniline sesquisulfate hydrate, 4-amino-3-methyl-N-ethyl-N-(b-hydroxyethyl)aniline sulfate, 4-amino-3-b-(methanesulfonamido)ethyl-N,N-diethylaniline hydrochloride and 4-amino-N-ethyl-N-(2-methoxyethyl)-m-toluidine di-p-toluene sulfonic acid.

Development is usually followed by the conventional steps of bleaching, fixing, or bleach-fixing, to remove silver or silver halide, washing, and drying.

In the working examples which follow, reference is made to antihalation dyes D-1, D-2, D-3 and D-4, cyan-dye-forming couplers C-1 and C-2, magenta-dye-forming couplers M-1 and M-2, yellow-dye-forming couplers Y-1, Y-2 and Y-3, bleach-accelerator-releasing coupler B-1, masking couplers CM-1 and CM-2, developer-inhibitor-releasing couplers DIR-1, DIR-2 and DIR-3, ultraviolet absorber UV-1, red-sensitizing dyes RSD-1 and RSD-2, green-sensitizing dyes GSD-1 and GSD- 2, blue-sensitizing dye YSD-1 and yellow filter dye YFD-1. These compounds have structures as indicated below:

D-1

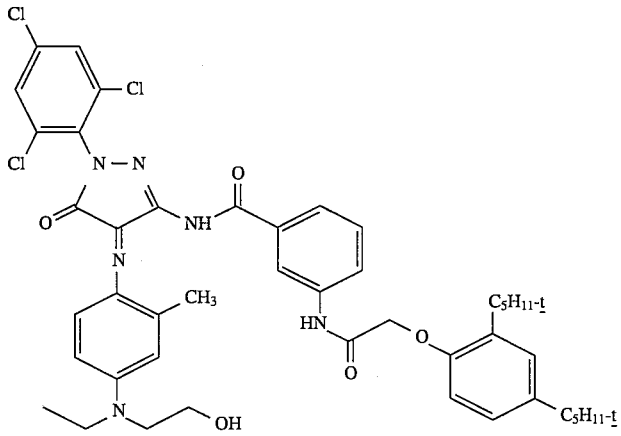

-continued
D-2
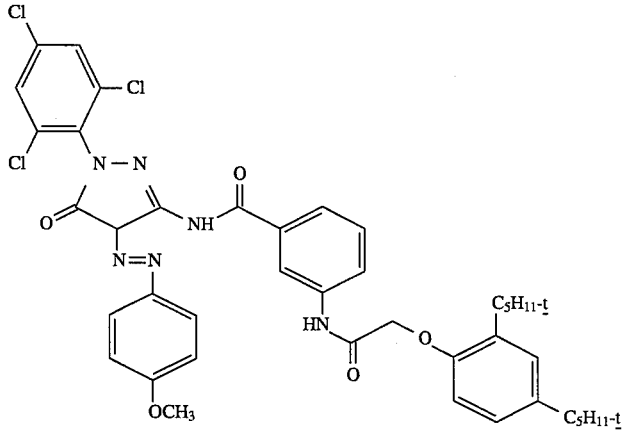
D-3
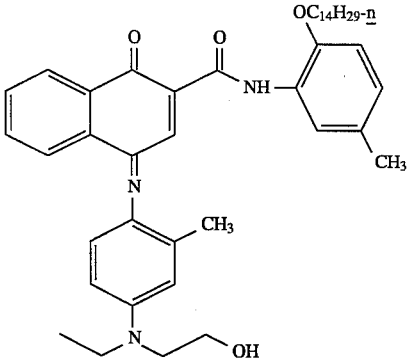
D-4
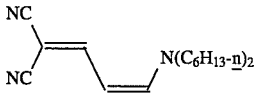
C-1
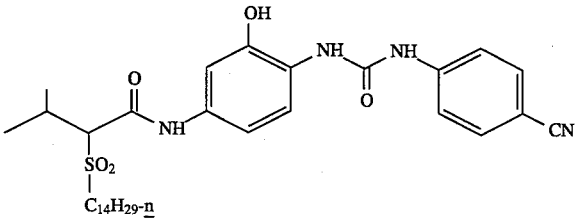
C-2
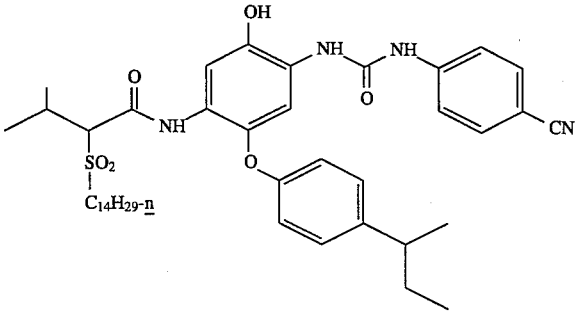

-continued
M-1
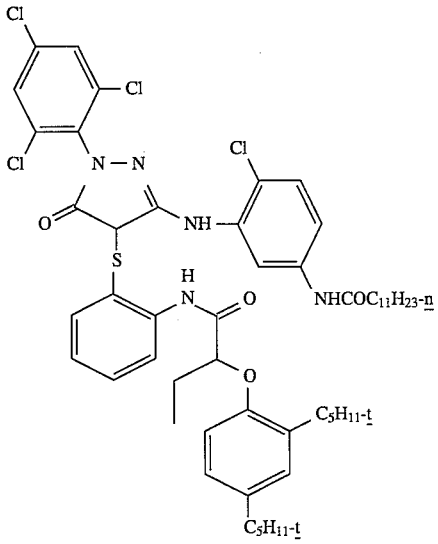
M-2
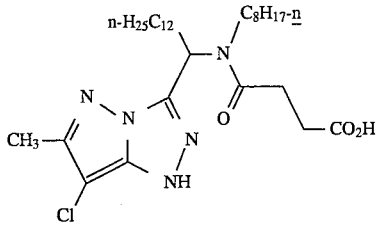
Y-1
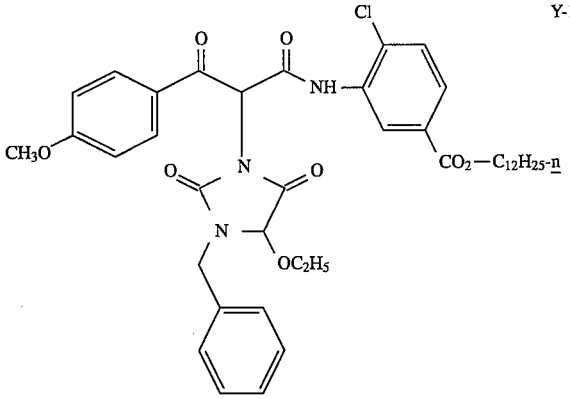
Y-2
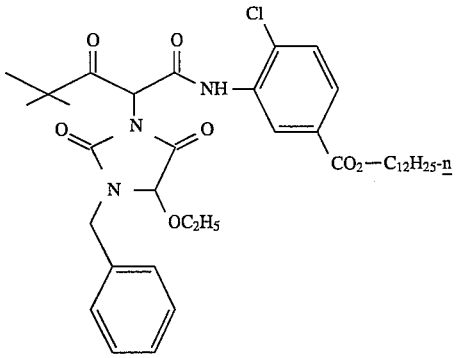
Y-3
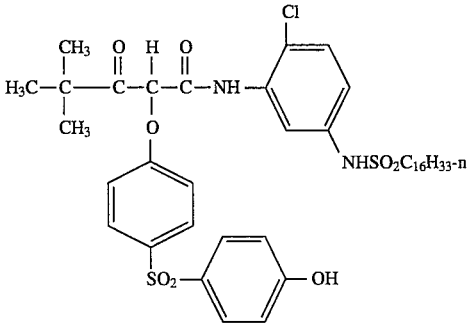
B-1
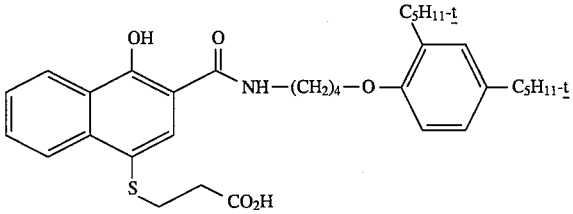

-continued
CM-1
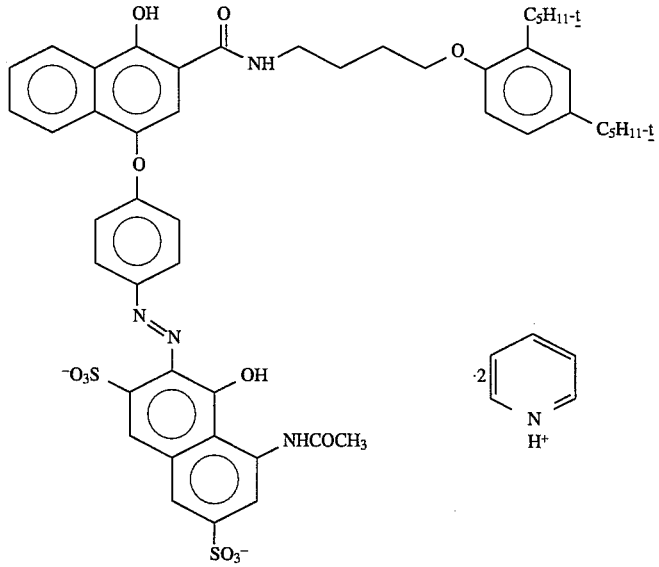
CM-2
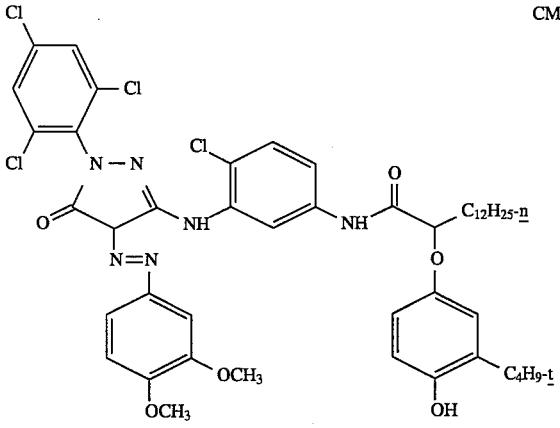
DIR-1
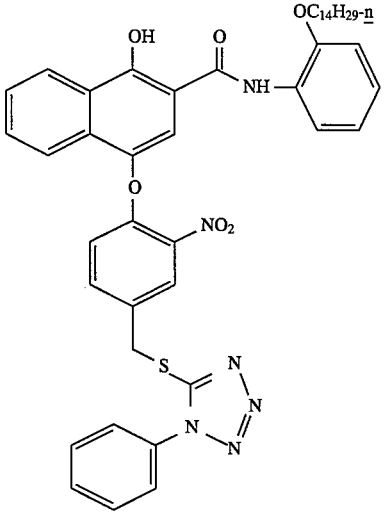
DIR-2
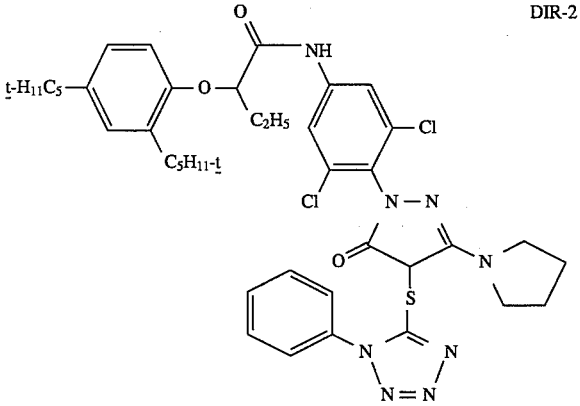
DIR-3
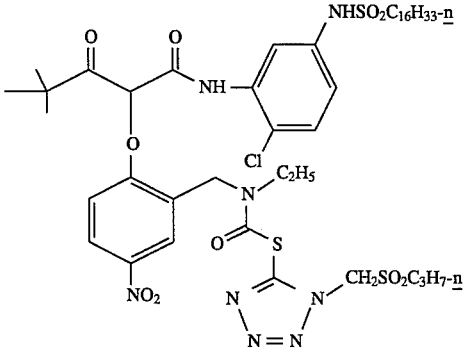

-continued

UV-1

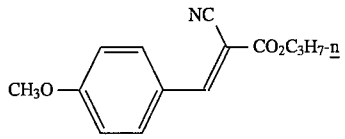

RSD-1

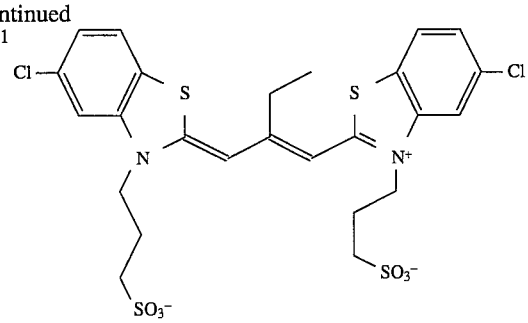

RSD-2

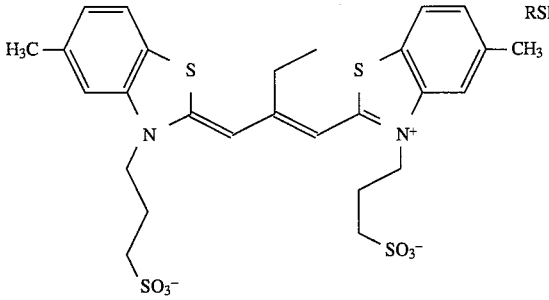

GSD-1

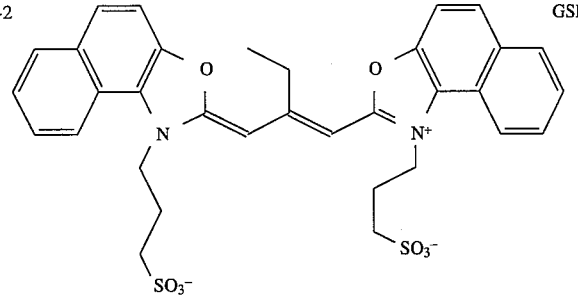

GSD-2

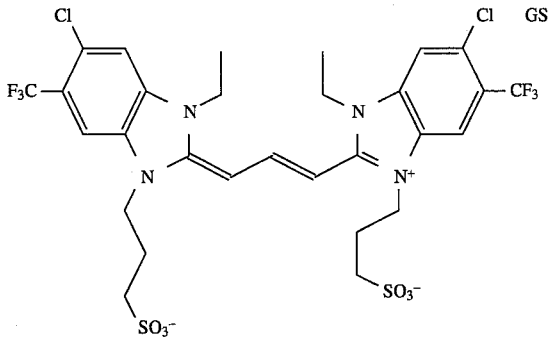

YSD-1

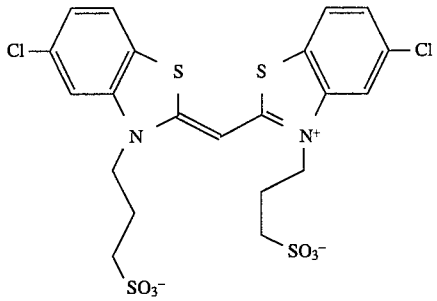

YFD-1

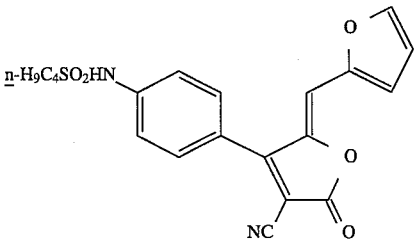

EXAMPLES 1–6

Photographic test elements were prepared by coating a cellulose acetate-butyrate film support with the following layers in the order indicated:

(1) an antihalation layer containing 0.32 g/m$^2$ of grey colloidal silver and 4.89 g/m$^2$ of gelatin;

(2) a photosensitive layer containing 2.42 g/m$^2$ of silver iodobromide emulsion, 1.08 g/m$^2$ of yellow image coupler Y-1, 0.325 g/m$^2$ of the antifoggant 5-methyl-S-triazole(2, 3a)pyrimidine-7-ol and 2.15 g/m$^2$ of gelatin;

(3) an interlayer containing 0.108 g/m$^2$ of a scavenger as indicated in Table I below and 0.65 g/m$^2$ of gelatin;

(4) a receiver layer containing 0.33 g/m$^2$ of magenta image coupler M-1 and 2.69 g/m$^2$ of gelatin; and (5) an overcoat layer containing 5.4 g/m$^2$ of gelatin with bis-vinylsulfonyl methyl ether hardener at 1.75 weight percent based on total gel.

Each test element was exposed imagewise through a stepped density test object and processed in the KODAK FLEXICOLOR (C-41) Process as described in the *The British Journal of Photography Annual.*, 1988, pp. 196–198.

In the format of the test element described above, magenta dye can be formed only by the wandering of oxidized developer from the layer in which it is generated through an interlayer to the layer containing the magenta coupler. Thus, the ability of the scavenger to prevent oxidized developer from wandering can be measured by the difference in green density measured at minimum and maximum exposure. Smaller delta green density (green density at $D_{max}$ minus green density at $D_{min}$) is indicative of improved scavenging.

The results obtained are reported in Table I below. In this table under the heading "Solvent" the weight ratio of scavenger to solvent, or combination of solvents, utilized is specified.

TABLE I

| Example No. | Scavenger | Solvent | Delta Green Density |
|---|---|---|---|
| Control 1 | None | — | 0.422 |
| 1 | S-1 | 1:0.5 CS-3 | 0.140 |
| 2 | S-2 | 1:0.5 CS-3 | 0.131 |
| 3 | S-3 | i:0.5 CS-3 | 0.102 |
| 4 | S-4 | 1:0.5 CS-3 | 0.124 |
| 5 | S-5 | 1:0.5 CS-3 | 0.165 |
| 6 | S-6 | 1:0.5 CS-3 | 0.109 |
| Comparison 1 | SC-1 | 1:0.95 CS-7:0.05 CS-8 | 0.228 |
| Comparison 2 | SC-2 | 1:0.95 CS-7:0.05 CS-8 | 0.258 |
| Comparison 3 | SC-1 + SC-2 | 1:0.95 CS-7:0.05 CS-8 | 0.259 |
| Comparison 4 | SC-3 | 1:0.5 CS-3 | 0.277 |
| Comparison 5 | SC-4 | 1:0.5 CS-3 | 0.266 |
| Comparison 6 | SC-5 | 1:0.5 CS-3 | 0.355 |
| Comparison 7 | SC-6 | 1:0.2 CS-3 | 0.199 |
| Comparison 8 | SC-7 | 1:0.5 CS-3 | 0.193 |
| Comparison 9 | SC-8 | 1:0.5 CS-3 | 0.194 |
| Comparison 10 | SC-9 | 1:0.5 CS-3 | 0.308 |
| Comparison 11 | SC-10 | 1:0.5 CS-3 | 0.258 |

As indicated by the data in Table I, scavengers within the scope of the present invention provided much lower values for delta green density than did the scavengers utilized in the comparison tests, thereby indicating that they provide much better scavenging activity.

EXAMPLE 7–8

To evaluate long-term stability towards oxidation of the scavengers of this invention and compare with prior art scavengers, three test elements were prepared in the same manner as described in Examples 1–6. Unexposed samples were stored at 3000 psi (20685 Pa) for 7 days and then processed in the manner described above. The results obtained are summarized in Table II below in which the increase in delta green density that is reported is the difference in delta green density between a sample kept for 7 days at 3000 psi (20685 Pa) and a sample kept for 7 days at normal atmospheric pressure.

TABLE II

| Example No. | Scavenger | Increase in Delta Green Density |
|---|---|---|
| 7 | S-1 | −0.033 |
| 8 | S-2 | +0.005 |
| Comparison 12 | SC-2 | +0.156 |

As shown by the data in Table II, scavengers S-1 and S-2, which are within the scope of the invention, are much more stable to oxidation than comparative scavenger SC-2 which is outside the scope of the invention.

EXAMPLE 9

To evaluate the extent of cyan sensitizing dye stain with use of a scavenger within the scope of the invention and compare it with a scavenger outside the scope of the invention, three test elements were prepared and processed in the same manner as described in Examples 1–6 and red density was measured. The results are reported in Table III below.

TABLE III

| Example No. | Scavenger | Solvent | Red Density |
|---|---|---|---|
| Control 2 | None | — | 0.253 |
| 9 | S-1 | 1:0.5 CS-3 | 0.260 |
| Comparison 13 | SC-10 | 1:0.5 CS-3 | 0.273 |

In Table III, red density refers to density at minimum exposure and arises from aggregated retained cyan sensitizing dye. The higher value obtained with comparative scavenger SC-10 is indicative of increased unwanted stain.

EXAMPLES 10–11

A multilayer photographic element, referred to herein as Control 3, was prepared by coating the following twelve layers on a cellulose triacetate film support. In each instance the coverage specified is in grams per square meter and the silver halide grain size reported in micrometers refers to diameter times thickness.

Layer 1 (Antihalation layer): black colloidial silver sol at 0.161; Dyes D-1 at 0.070, D-2 at 0.036, D-3 at 0.014 and D-4 .at 0.075 and gelatin at 2.15.

Layer 2 (First Interlayer): Gelatin at 0.646.

Layer 3 (Slow cyan layer): a blend of two red sensitized (both with a mixture of RSD-1 and RSD-2) silver iodobromide emulsions: (i) a large sized tabular grain emulsion (0.50×0.085, 1.5 mole % I) at 0.323 and (ii) a smaller tabular emulsion (1.16×0.052, 5.1 mole % I) at 0.570; gelatin at 2.58; cyan dye-forming coupler C-1 at 0.646; DIR coupler DIR-1 at 0.038; bleach accelerator releasing coupler B-1 at 0.054, antifoggant 4-hydroxy-6-methyl-1,3,3a,7-tetraazaindene at 0.016 and gelatin at 2.582.

Layer 4 (Fast cyan layer): a red-sensitized (same as above) tabular silver iodobromide emulsion (1.99×0.063, 5.1 mole % I) at 0.4430; cyan coupler C- 2 at 0.118; DIR-1 at 0.027; masking coupler CM-1 at 0.032; gelatin at 1.29 and antifoggant 4-hydroxy-6-methyl- 1,3,3a,7-tetraazaindene at 0.006.

Layer 5 (Second Interlayer): Gelatin at 0.646.

Layer 6 (Slow magenta layer): a green sensitized (with a mixture of GSD-1 and GSD-2) tabular silver iodobromide emulsion (0.5×0.085, 1.5 mole % iodide) at 0.161; magenta dye forming coupler M-1 at 0.215; gelatin at 0.807 and antifoggant 4-hydroxy-6-methyl- 1,3,3a,7-tetraazaindene at 0.001.

Layer 7 (Mid magenta layer): a blend of two green sensitized (same as above) tabular silver iodobromide emulsions (i) 1.75×0.049, 7.05 mole % iodide and (ii) 1.20×0.054, 6.2 mole % I) at a total of 0.463; M-1 at 0.247; M-2 at 0.075; CM-2 at 0.129; DIR-1 at 0.032; DIR-2 at 0.005; gelatin at 1.02 and 4-hydroxy- 6-methyl-1,3,3a,7-tetraazaindene at 0.003.

Layer 8 (Fast magenta layer): a green sensitized (same as above) tabular silver iodide emulsion (1.99×0.063, 5.1% iodide) at 0.430; M-2 at 0.086; CM-2 at 0.043; DIR-2 at 0.001; gelatin at 1.01 and 4-hydroxy-6-methyl-1,3,3a,7-tetraazaindene at 0.006.

Layer 9 (Yellow filter layer): Gelatin at 0.646 and YFD-1 at 0.108.

Layer 10 (Slow yellow layer): a blend of three blue sensitized (all with YSD-1) tabular silver iodobromide emulsions ((i) 2.00 x 0.062, 3.15 mole % I (ii) 1.19×0.046, 3.0 mole % I and (iii) 0.5×0.080, 1.5 mole % I) at a total of 0.387; yellow dye forming coupler Y-1 at 0.215; Y-2 at 0.968; DIR-3 at 0.032; B-1 at 0.005, 4-hydroxy-6-methyl-1,3,3a,7-tetraazaindene at 0.006 and gelatin at 1.775.

Layer 11 (Fast yellow layer): a blue sensitized (with YSD-1) tabular silver iodobromide emulsion (2.79×0.072, 2.7 mole % I) at 0.322; Y-1 at 0.075; Y-2 at 0.344; DIR-3 at 0.064; 4-hydroxy-6-methyl- 1,3,3a,7-tetraazaindene at 0.005 and gelatin at 1.08.

Layer 12 (Protective overcoat and UV filter layer): gelatin at 1.08; silver bromide Lippman emulsion at 0.108; D-4 and UV-1 (1:1 ratio) at a total of 0.023 and bis(vinylsulfonyl-)methane hardener at 1.8% of total gelatin weight.

Surfactants (a mixture of TRITON X-200E and OLIN 10G), coating aids, emulsion addenda, matte and tinting dyes were added to the appropriate layers as is common in the art.

An otherwise identical multilayer photographic element, referred to as Comparison 14, was prepared in which there was added to layers 2, 5 and 9 the comparative scavenger SC-2 at 0.075.

An otherwise identical multilayer photographic element, referred to as Comparison 15, was prepared in which there was added to layers 2, 5 and 9 the comparative scavenger SC-1 at 0.075.

An otherwise identical multilayer photographic element, referred to as Example 10, was prepared in which there was added to layers 2, 5 and 9 scavenger S-2, which is within the scope of the invention, at 0.075.

An otherwise identical multilayer photographic element, referred to as Example 11, was prepared in which scavenger S-2 was added at 0.011 to the most green-sensitive emulsion layer 8 and at 0.016 to the mid green-sensitive emulsion layer 7.

The multilayer photographic elements, of Control 3, Comparisons 14 and 15 and Examples 10 and 11 were given separate stepped green and red separation exposures, that is, only one color record at a time was exposed. In this manner, the effectiveness of the oxidized developer scavenger can be measured by determining the decrease in density in the other non-exposed layers. Effective scavengers will prevent oxidized developer from wandering from the exposed layer where it is generated to other layers and forming dye. This was determined by measuring the appropriate densities of the separation exposures at midscale (+0.7 log E exposure over the $D_{min}$+0.15 density speed point).

The results obtained are summarized in Table IV below.

TABLE IV

| Example No. | Green Gamma (neutral exposure) | Decrease in Red Density (Green Exposure) |
|---|---|---|
| Control 3 | 0.719 | Check |
| Comparison 14 | — | −0.031 |
| Comparison 15 | — | −0.013 |
| Example 10 | — | −0.070 |
| Example 11 | 0.734 | −0.029 |

As shown by the data in Table IV, scavenger S-2 which is employed in examples 10 and 11, is an effective interlayer scavenger since it prevents density increases in the red layer when the green layer is exposed. In addition, when scavenger S-2 was added directly to an imaging layer as in Example 11, green gamma was increased relative to Control 3.

It is known in the art that hydrazides can improve the keeping of latent image and minimize sensitivity losses upon storage after exposure but before processing. For examples, see "Stabilization of Photographic Silver Halide Emulsions", E. Birr, Focal Press, London, England, 1974, p. 42, 121–126; U.S. Pat. Nos. 2,245,236; 3,386,331; and 3,295,981. As demonstrated in Table V below, Scavenger S-2 is excellent at preventing latent; image losses upon incubation. In Table V, Green Density Loss is the change in density at midscale between an element kept 1 week at 23.5 degrees C and 50% relative humidity, given an exposure and then stored 3 additional weeks compared to the same element kept 4 weeks under the same conditions and exposed 24 hrs before processing. Green Sensitivity Loss is the difference in green sensitivity of the same elements measured at+0.15 density units above $D_{min}$.

TABLE V

| Example No. | Green Density Loss | Green Sensitivity Loss |
|---|---|---|
| Control 3 | −0.169 | −17.3 |
| Comparison 14 | −0.198 | −24.4 |
| Comparison 15 | −0.174 | −18.3 |
| Example 10 | −0.137 | −14.4 |

As shown by the above examples, hydrazide compounds which have the structural features required by this invention are markedly superior to previously known hydrazide scavengers as well as to other well-known classes of scavenging compounds. The essential structural features include at least one polyhydroxy aromatic nucleus or a precursor thereof, at least one moiety containing an $$-\overset{|}{N}-\overset{|}{N}-$$

group, and a linking group, selected from oxy, thio, sulfinyl, sulfonyl, carbonyl or alkylene, which is directly attached to a ring carbon atom of the polyhydroxy aromatic nucleus or precursor thereof. When the linking group is carbonyl there must be at least three hydroxyl groups on the polyhydroxy aromatic nucleus to counteract the electron withdrawing characteristics of a carbonyl group. When the linking group is one of the other specified groups there can be two or more hydroxyl groups on the polyhydroxy aromatic nucleus.

The invention has been described in detail, with particular reference to certain preferred embodiments thereof, but it should be understood that variations and modifications can be effected within the spirit and scope of the invention.

We claim:

1. A photographic element comprising a support bearing at least one silver halide emulsion layer having associated therewith a hydrazide compound that functions as a scavenger for oxidized developing agent; said hydrazide compound:

(a) comprising at least one polyhydroxy aromatic nucleus or a precursor thereof; said precursor having an aromatic nucleus substituted with labile groups which form hydroxyl groups upon processing of said photographic element;

(b) comprising at least one moiety containing an $$-\overset{|}{N}-\overset{|}{N}-$$

group wherein said moiety is bonded to a ring carbon atom of said polyhydroxy aromatic nucleus or precursor thereof through an oxy, thio, sulfinyl, that when said moiety is bonded to said ring carbon atom through a carbonyl group then said polyhydroxy aromatic nucleus comprises at least three hydroxyl groups; and (c) having sufficient bulk that it is substantially non-diffusible in said photographic element.

2. A photographic element as claimed in claim 1, wherein said polyhydroxy aromatic nucleus is a polyhydroxybenzene nucleus.

3. A photographic element as claimed in claim 1, wherein said polyhydroxy aromatic nucleus is a dihydroxybenzene nucleus.

4. A photographic element as claimed in claim 1, wherein said alkylene group contains 1 to 8 carbon atoms.

5. A photographic element as claimed in claim 1, wherein said hydrazide compound has the formula:

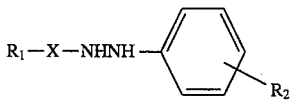

wherein

X represents

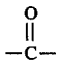

or —$SO_2$—, $R_1$ represents an alkyl, alkyloxy, aryl, aryloxy, aralkyl or amino group;

$R_2$ represents hydrogen or an alkyl, alkyloxy, aryl, aryloxy, aralkyl, amino, acylamido, sulfonamido or ureido group;

at least one of $R_1$ and $R_2$ contains a polyhydroxybenzene group of the formula:

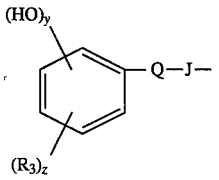

wherein:

y=2 and the OH groups are in a 1,2 or 1,4 relationship to each other;

Q=oxygen, sulfur or a

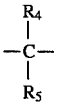

group;

$R_3$=hydrogen, aryl, sulfonamido, carbonamido, sulfonic acid, a salt of sulfonic acid, halogen, alkyl or alkyloxy;

$R_4$ and $R_5$ are individually hydrogen, alkyl, aryl, thiol, amino, aryloxy or alkyloxy and $R_4$ and $R_5$ can form a ring system when taken together or when taken in combination with R3;

z=0–3;

J is an optional linking group that chemically connects Q to $R_1$ or $R_2$.

6. A photographic element as claimed in claim 1, wherein said hydrazide compound has the formula:

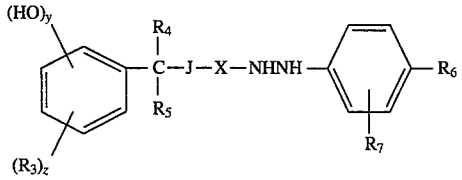

wherein X represents

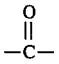

or —$SO_2$—,

J is an optional linking group, $R_3$=hydrogen, aryl, sulfonamido, carbonamido, sulfonic acid, a salt of sulfonic acid, halogen, alkyl or alkyloxy, z=0–3, y=2 and the OH groups are in a 1, 2 or 1, 4 relationship to each other;

$R_4$ and $R_5$ are individually hydrogen, alkyl, aryl, thio, amino, aryloxy or alkyloxy and $R_4$ and $R_5$ can form a ring system when taken together or when taken in combination with $R_3$;

$R_6$ and $R_7$ individually represent a group that has a para Hammett Substituent Constant less than 0.10 and $R_6$ and $R_7$ taken together with the atoms to which they are attached can form a ring system.

7. A photographic element as claimed in claim 6, wherein $R_6$ and $R_7$ individually represent hydrogen, alkyl, alkyloxy, carboxy, carbonamido, sulfonamido or amino.

8. A photographic element as claimed in claim 1, wherein said hydrazide compound has the formula:

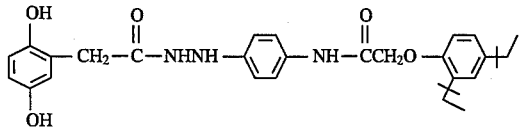

9. A photographic element as claimed in claim 1, wherein said hydrazide compound has the formula:

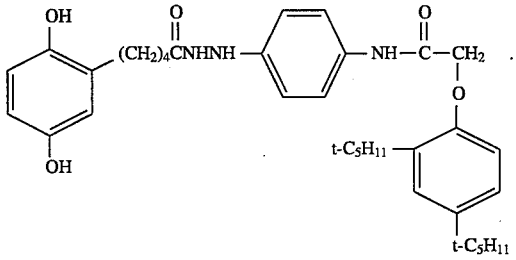

10. A photographic element as claimed in claim 1, wherein said hydrazide compound has the formula:

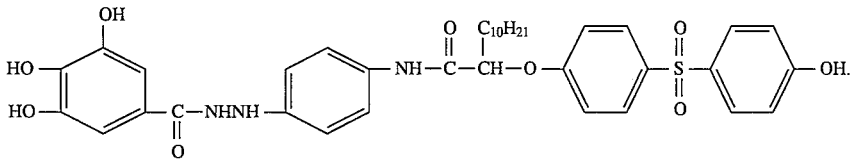

11. A photographic element as claimed in claim 1, wherein said hydrazide compound has the formula:

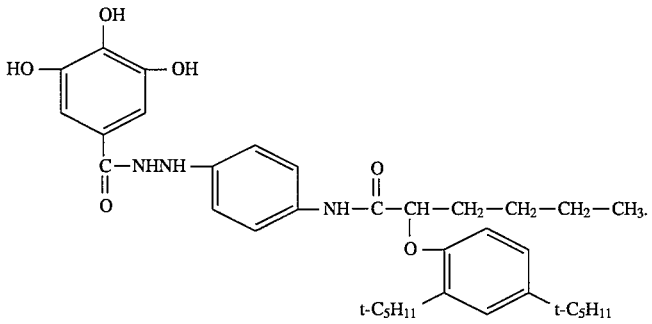

12. A photographic element as claimed in claim 1, wherein said hydrazide compound has the formula:

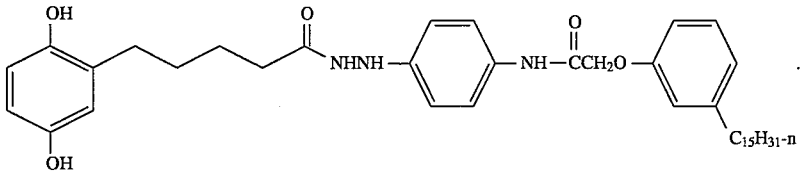

13. A photographic element as claimed in claim 1, wherein said hydrazide compound has the formula:

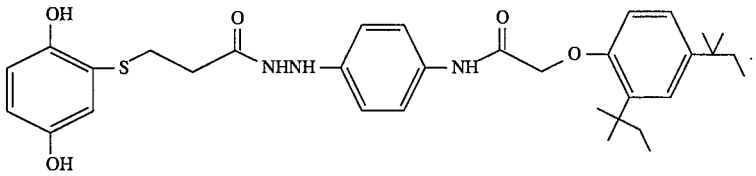

14. A multicolor photographic element comprising a support having thereon:

(1) a blue-recording yellow-dye-image-forming layer unit;

(2) a green-recording magenta-dye-image-forming layer unit; and (3) a red-recording cyan-dye-image-forming layer unit, each of said dye-image-forming layer units containing at least one silver halide emulsion layer comprised of gelatin and silver halide grains and said element additionally comprising a scavenger for oxidized-color-developing agent; said scavenger being a hydrazide compound which:

(a) comprises at least one polyhydroxy aromatic nucleus or a precursor thereof; said precursor having an aromatic nucleus substituted with labile groups which form hydroxyl groups upon processing of said photographic element;

(b) comprises at least one moiety containing an $$-\overset{|}{N}-\overset{|}{N}-$$

group wherein such moiety is bonded to a ring carbon atom of said polyhydroxy aromatic nucleus or precursor thereof through an oxy, thio, sulfinyl, sulfonyl, carbonyl or alkylene group, with the proviso that when said moiety is bonded to said ring carbon atom through a carbonyl group then said polyhydroxy aromatic nucleus comprises at least three hydroxyl groups; and (c) has sufficient bulk that it is substantially non-diffusible in said photographic element.

15. A photographic element as claimed in claim 14, wherein said polyhydroxy aromatic nucleus is a polyhydroxybenzene nucleus.

16. A photographic element as claimed in claim 14, wherein said polyhydroxy aromatic nucleus is a dihydroxybenzene nucleus.

17. A photographic element as claimed in claim 14, wherein said alkylene group contains 1 to 8 carbon atoms.

18. A multicolor photographic element comprising a support having thereon:

(1) a blue-recording yellow-dye-image-forming layer unit;

(2) a green-recording magenta-dye-image-forming layer unit; and (3) a red-recording cyan-dye-image-forming layer unit, each of said dye-image-forming layer units containing at least one silver halide emulsion layer comprised of gelatin and silver halide grains and said element additionally comprising a scavenger for oxidized-color-developing agent; said scavenger being a hydrazide compound of the formula:

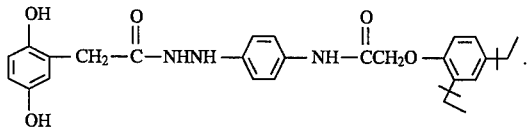

19. A multicolor photographic element comprising a support having thereon:

(1) a blue-recording yellow-dye-image-forming layer unit;

(2) a green-recording magenta-dye-image-forming layer unit; and (3) a red-recording cyan-dye-image-forming layer unit, each of said dye-image-forming layer units containing at least one silver halide emulsion layer comprised of gelatin and silver halide grains and said element additionally comprising a scavenger for oxidized-color-developing agent; said scavenger being a hydrazide compound of the formula:

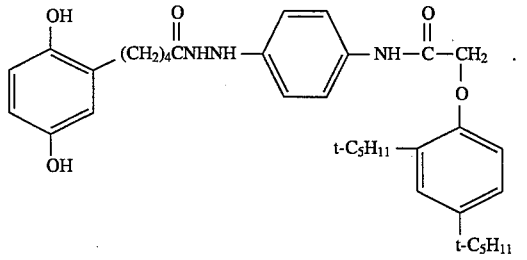

20. A photographic element comprising a support bearing at least one silver halide emulsion layer having associated therewith a hydrazide compound that functions as a scavenger for oxidized developing agent; said hydrazide compound:

(a) comprising at least one polyhydroxy aromatic nucleus or a precursor thereof; said precursor having an aromatic nucleus substituted with labile groups which form hydroxyl groups upon processing of said photographic element; said labile groups being selected from alkyl esters, sulfonyl esters, carbamates, phosphates and carbonates;

(b) comprising at least one moiety containing an

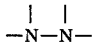

group wherein said moiety is bonded to a ring carbon atom of said polyhydroxy aromatic nucleus or precursor thereof through an oxy, thio, sulfinyl, sulfonyl, carbonyl or alkylene group, with the proviso that when said moiety is bonded to said ring carbon atom through a carbonyl group then said polyhydroxy aromatic nucleus comprises at least three hydroxyl groups; and (c) having sufficient bulk that it is substantially non-diffusible in said photographic element.

21. A photographic element as claimed in claim 20, wherein said hydrazide compound has the formula:

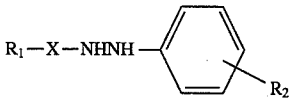

wherein

X represents

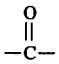

or $—SO_2—$, $R_1$ represents an alkyl, alkyloxy, aryl, aryloxy, aralkyl or amino group;

$R_2$ represents hydrogen or an alkyl, alkyloxy, aryl, aryloxy, aralkyl, amino, acylamido, sulfonamido or ureido group;

at least one of $R_1$ and $R_2$ contains a polyhydroxybenzene group of the formula:

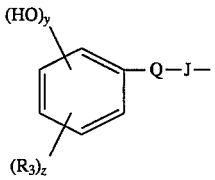

wherein:

y=2 and the OH groups are in a 1,2 or 1,4 relationship to each other;

Q=oxygen, sulfur or a

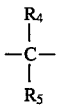

group;

$R_3$=hydrogen, aryl, sulfonamido, carbonamido, sulfonic acid, a salt of sulfonic acid, halogen, alkyl or alkyloxy;

$R_4$ and $R_5$ are individually hydrogen, alkyl, aryl, thiol, amino, aryloxy or alkyloxy and $R_4$ and $R_5$ can form a ring system when taken together or when taken in combination with $R_3$;

z=0–3;

J is an optional linking group that chemically connects Q to $R_1$ or $R_2$ and is represented by —Z—, $—(CR_4R_5)_x—$, $—(CR_4R_5)_x—Z—$, $—Z—(CR_4R_5)_x—Z—$ or $—(CR_4R_5)_x—Z—(CR_4R_5)_w—$ wherein Z=oxygen or mono-substituted nitrogen, x=1 to 30 and w=1 to 30.

22. A photographic element as claimed in claim 20, wherein said hydrazide compound has the formula:

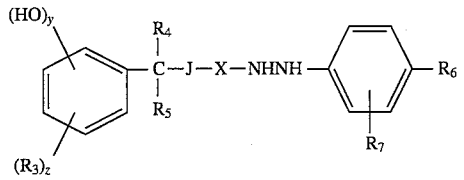

wherein X represents

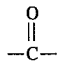

or $—SO_2—$,

J is an optional linking group and is represented by $—Z—$, $—(CR_4R_5)_x$, $—(CR_4R_5)_x—Z—$, $—Z(CR_4R_5)_x—Z—$ or $—(CR_4R_5)_x—Z—(CR_4R_5)_w—$ wherein Z=oxygen or mono-substituted nitrogen, x=1 to 30 and w=1 to 30, $R_3$=hydrogen, aryl, sulfonamido, carbonamido, sulfonic acid, a salt of sulfonic acid, halogen, alkyl or alkyloxy, z=0–3, y=2 and the OH groups are in a 1, 2 or 1, 4 relationship to each other;

$R_4$ and $R_5$ are individually hydrogen, alkyl, aryl, thio, amino, aryloxy or alkyloxy and $R_4$ and $R_5$ can form a ring system when taken together or when taken in combination with $R_3$;

$R_6$ and $R_7$ individually represent a group that has a para Hammett Substituent Constant less than 0.10 and $R_6$ and $R_7$ taken together with the atoms to which they are attached can form a ring system.

* * * * *